US005446988A

United States Patent [19]

Frederick, Jr.

[11] Patent Number: 5,446,988

[45] Date of Patent: Sep. 5, 1995

[54] FIREARM SAFETY DEVICE

[76] Inventor: Albert Frederick, Jr., 2597 W. River Rd., Newton Falls, Ohio 44444

[21] Appl. No.: 259,400

[22] Filed: Jun. 14, 1994

[51] Int. Cl.[6] ..... F41A 17/02

[52] U.S. Cl. ..... 42/70.11; 42/66; 42/70.08

[58] Field of Search ..... 42/70.11, 70.01, 66, 42/70.08

[56] References Cited

U.S. PATENT DOCUMENTS

| | | | |
|---|---|---|---|
| 2,327,334 | 8/1943 | Parker | 42/70.11 |
| 3,022,598 | 2/1962 | Wikstrom | 42/66 |
| 4,392,318 | 7/1983 | Daniels | 42/70.11 |
| 4,398,366 | 8/1983 | Wernicki | 42/70.11 |
| 4,412,397 | 11/1983 | Bayn | 42/70.11 |
| 4,569,144 | 2/1986 | Thurber | 42/70.11 |
| 4,961,277 | 10/1990 | Rosenbaum | 42/70.11 |
| 4,999,940 | 3/1991 | Madden | 42/70.11 |
| 5,000,075 | 3/1991 | Tuma | 89/147 |
| 5,001,854 | 3/1991 | Derman | 42/70.11 |
| 5,099,596 | 3/1992 | Butler, Jr. | 42/70.11 |

FOREIGN PATENT DOCUMENTS

| | | | |
|---|---|---|---|
| 2635581 | 2/1990 | France | 42/70.11 |

*Primary Examiner*—Stephen M. Johnson
*Attorney, Agent, or Firm*—MacMillan, Sobanski & Todd

[57] ABSTRACT

An improved firearm safety device for installation on a firearm having a hammer and a barrel. The safety device includes a first section having one end extending around the hammer of the firearm, and an opposite end having an arm provided with serrations formed along a portion thereof. The safety device further includes a second section having a releasable lock and a plug. The lock includes a bore formed therethrough for receiving the portion of the arm having serrations and is operative to lock the second section to the first section, and the plug extends into the barrel of the firearm such that, when the first section is locked to the second section, the one end maintains the hammer in an uncocked, forward position and the plug is retained within the barrel.

20 Claims, 2 Drawing Sheets

FIREARM SAFETY DEVICE

BACKGROUND OF THE INVENTION

This invention relates in general to firearms and, in particular, to an improved safety device for firearms.

There are numerous types of safety devices which can be installed on a firearm to prevent the firearm from being discharged unless the device is removed.

One example of a safety device for a handgun is disclosed in U.S. Pat. No. 4,961,277 to Rosenbaum. As shown in the Rosenbaum patent, the safety device includes a strap, a block, and a cap. The strap extends around the hammer of the handgun, and has a pair of arms secured in the block which is positioned against the muzzle of the handgun. The cap is removably attached to the block by a snap fit engagement therewith, and includes a pin which extends into the muzzle of the handgun to prevent the removal of the cap and block from the handgun, and thus prevent removal of the strap from the hammer.

Other examples of safety devices for various kinds of firearms are disclosed in U.S. Pat. No. 5,099,596 to Butler, Jr., U.S. Pat. No. 5,001,596 to Derman, U.S. Pat. No. 5,000,075 to Tuma, U.S. Pat. No. 4,569,144 to Thurber, U.S. Pat. No. 4,412,397 to Bayn, U.S. Pat. No. 4,392,318 to Daniels, and U.S. Pat. No. 3,022,598 to Wilkstrom.

SUMMARY OF THE INVENTION

This invention relates to an improved firearm safety device for installation on a firearm having a hammer and a barrel. In particular, the firearm safety device includes a first section having one end extending around the hammer of the firearm, and an opposite end having an arm provided with serrations formed along a portion thereof. The safety device further includes a second section having a releasable lock and a plug. The lock includes a bore formed therethrough for receiving the portion of the arm having serrations and is operative to lock the second section to the first section, and the plug extends into the barrel of the firearm such that, when the first section is locked to the second section, the one end maintains the hammer in an uncocked, forward position and the plug is retained within the barrel.

One advantage of the safety device of the present invention is that it can be used on different types of firearms. Another advantage of the safety device of the present invention is that it is readily adjustable to accommodate different barrel lengths and calibers. Other advantages of this invention will become apparent to those skilled in the art from the following detailed description of the preferred embodiment, when read in light of the accompanying drawings.

DESCRIPTION OF THE PREFERRED EMBODIMENT

Figure 1:
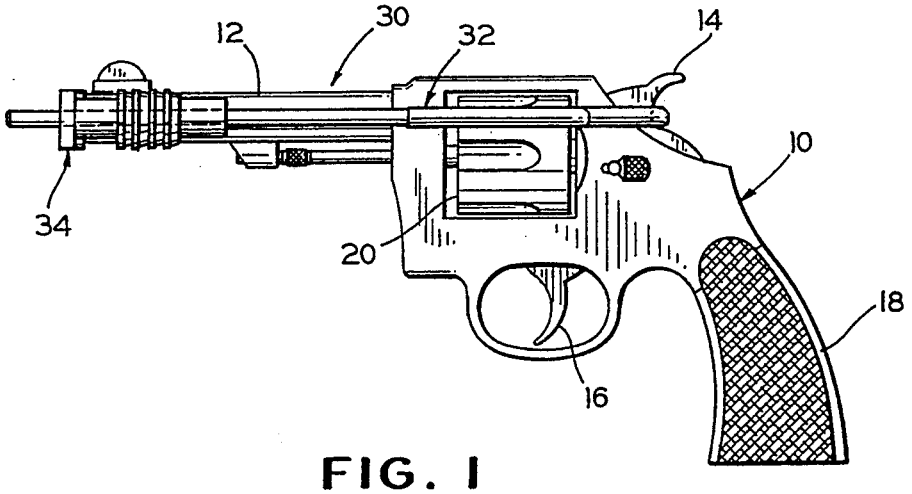
FIG. 1 is a side view of a firearm having a safety device installed thereon constructed in accordance with the present invention.

Referring now to the drawings, there is illustrated in FIG. 1 a revolver or pistol 10, and which can incorporate an improved safety device, indicated generally at 30, embodying the principles of the present invention. It must be understood that while the safety device 30 is shown as being used for the particular handgun shown in FIG. 1, it can be used with any type of firearm having an exposed hammer and a barrel. For example, the safety mechanism 30 can be used on a semi-automatic pistol (not shown), a rifle (not shown), and a shotgun (not shown) to name a few.

The pistol 10 includes a barrel or muzzle 12, a hammer 14, a trigger 16, a hand grip 18, and a cartridge cylinder 20. The operation of the pistol 10 is well known, and will briefly be discussed. The pistol 10 is fired by pulling the trigger 16 to the right in FIG. 1. At the same time, the hammer 14 moves to the right. When the trigger 16 has been sufficiently moved, the hammer 14 moves to the left and a firing pin (not shown) of the hammer 14 strikes an end of a cartridge (not shown) installed in the cartridge cylinder 20. As a result, the cartridge is propelled out through the barrel 12 of the pistol 10.

The safety device 30 of the present invention includes a generally U-shaped first section 32, and a generally U-shaped second section 34 which is releasably coupled to the first section 32. The first section 32 includes a closed-end 36 and a pair of arms 38 and 40, best shown in FIGS. 2 and 3. As shown in this embodiment, the arm 38 is provided with serrations or notches 42 along a portion thereof. The first section 32 is preferably constructed of steel, and a protective rubber sleeve 44 is installed on a the closed end 36 and extends along a portion of the arms 38 and 40.

The second section 34 includes a generally closed end 46 and a pair of arms 48 and 50. The arms 48 and 50 are provided with openings 52 and 54, respectively, formed therethrough. The arm 48 includes an integral manual lock 60 which is shown in this embodiment as comprising a combination type lock. The closed end 46 carries a stud or bushing 62. Preferably, the stud 62 is formed from steel and is received in an interference fit in an opening 47 provided in the closed end 46 of the second section 34.

The second section 34 further includes an annular sleeve 64 which is removably secured to an exposed end 66 of the stud 62 by an interference fit therewith. As will be discussed below, the sleeve 64 includes an outer diameter which is selected so as to enable the sleeve 64 to be received inside the barrel 12 of the particular caliber of firearm 10. Alternatively, the stud 62 and sleeve 64 can be constructed as a one-piece plug (not shown). An rubber O-ring 68 is installed over the sleeve 64 and moved against an inner surface 70 of the closed end 46. Preferably, the sleeve 64 is formed from brass.

The safety device 30 is installed on the pistol 10 by positioning the first section 32 so that the closed end 36 extends around the hammer 14, and the arms 38 and 40 extend on opposite sides along the length of the barrel 12. The second section 34 is then secured to the first section 32 by inserting the ends of the arms 38 and 40 through the openings 52 and 54 of the arms 48 and 50, respectively. As second section 34 is further inserted, the sleeve 64 is received into the barrel 12 of the pistol 10, and the O-ring 68 is seated against an end 13 of the barrel 12.

Figure 2:
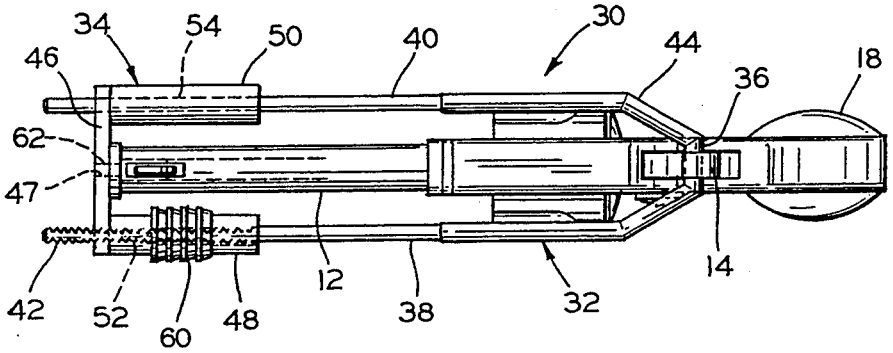
FIG. 2 is a top view of the firearm illustrated in FIG. 1.

Once the safety device 30 is installed on the pistol 10, as shown in FIGS. 1 and 2, the combination lock 60 is moved from the preset combination to a random combination. As a result, the safety device 30 is positively affixed on the firearm 10 and the discharge of the firearm 10 is prevented. In order to remove the safety device 30 from the pistol 10, the combination lock 60 must be turned to the preset combination so that the second section 34 and first section 32 can be separated from one another.

Figure 3:
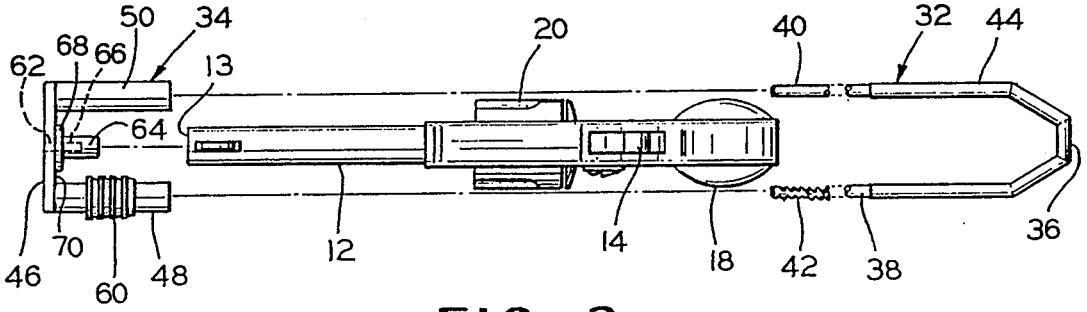
FIG. 3 is a top view similar to FIG. 2, showing the safety device prior to installation on the firearm.
Figure 4:
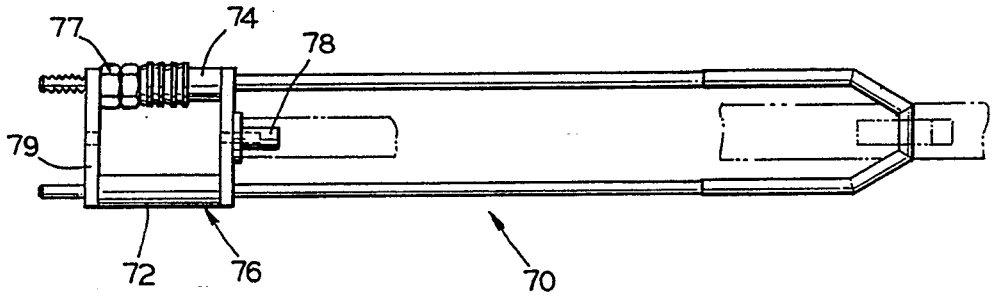
FIG. 4 is a top view of an alternate embodiment of a firearm safety device.

Turning now to FIG. 4, there is illustrated another embodiment of a safety device 70 which is similar to the safety device 30 shown in FIGS. 1–3, except that arms 72 and 74 of a second section 76 thereof extend in an opposite direction relative to a removable sleeve 78. Also, the safety device 70 includes a removable nut 77 and a pivotable base plate 79 is provided on an outboard end of the second section 76.

Figure 5:
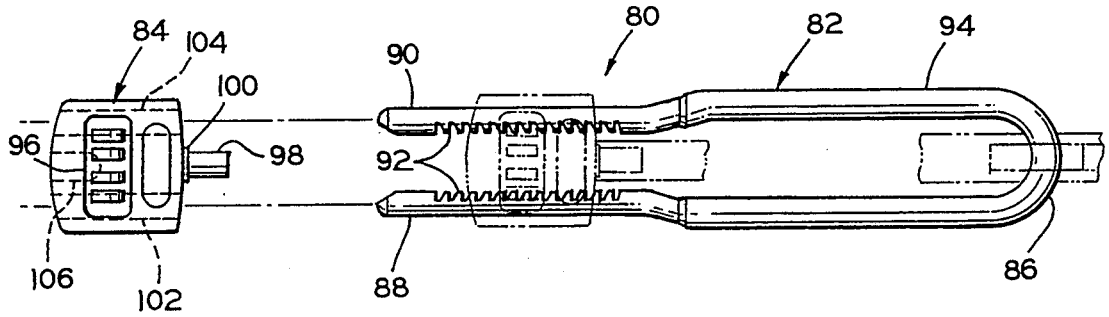
FIG. 5 is a top view of another embodiment of a firearm safety device.

Turning now to FIG. 5, another embodiment of a safety device 80 is illustrated. The safety device 80 includes a first section 82 and a second section 84. The first section 82 includes a closed end 86 and a pair of arms 88 and 90. The arms 88 and 90 are provided with serrations or notches 92 along a portion thereof. The first section 82 is preferably constructed of steel, and a protective rubber sleeve 94 is installed on the closed end 86 and extends along a portion of the arms 88 and 90.

The second section 84 includes an integral manual combination type lock 96, or alternatively a key type lock (not shown) having a keyed opening 106, a removable sleeve 98, and an O-ring 100. A pair of openings 102 and 104 are formed through the second section 84, and are adapted to receive the arms 90 and 92 of the first section 82.

Figure 6:
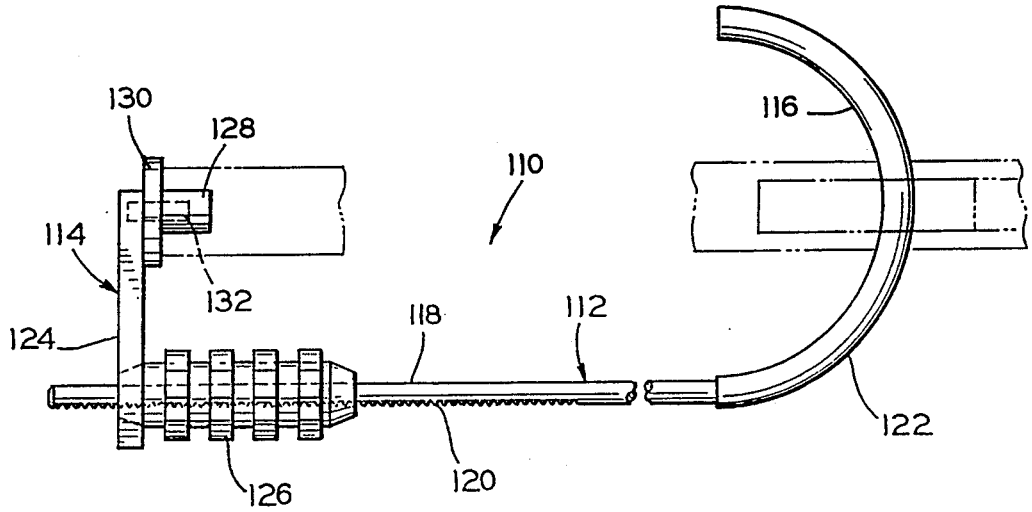
FIG. 6 is a partial, top view of yet another embodiment of a firearm safety device.

FIG. 6 illustrates yet another embodiment of a firearm safety device 110 constructed in accordance with the present invention. The safety device 110 includes a first section 112 and a second section 114. The first section 112 includes a hooked end 116 and an arm 118. The arm 118 is provided with serrations 120, and a protective rubber sleeve 122 is installed on the end 116 and extends along a portion of the arm 118.

The second section 114 includes a base plate 124, a manual combination lock 126, a sleeve 128, and an O-ring 130. The sleeve 128 is removably secured to the base plate 124 by a stud 132, and is selected to fit the particular caliber of firearm. Preferably, the safety device 110 is used on firearms having relatively long barrels, such as for example, a rifle and a shotgun.

One advantage of the safety device of the present invention is that it can be used on different types of firearms. Another advantage of the safety device of the present invention is that it is readily adjustable to accommodate different barrel lengths of firearms. Still another advantage of the present invention is that it is readily adaptable to different calibers of firearms by selecting a particular sized sleeve. Still yet another advantage of the safety device of the present invention is that once it is installed on the firearm, it cannot be easily removed unless the preset combination is selected.

In accordance with the provisions of the patents statues, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. A firearm safety device for installation on a firearm including a hammer and a barrel, the safety device comprising:

a generally U-shaped first section including one end extending around the hammer of the firearm and an opposite end having a first arm and a second arm extending generally parallel to said first arm, said first arm provided with serrations formed along a portion thereof; and a second section including a releasable lock, a hollow sleeve and a plug, said lock having a bore formed therethrough for receiving said first arm, said lock engageable with said serrations and operative to lock said second section to said first section after said first arm of said first section has been inserted into said bore of said lock, said second arm of said first section is inserted into said hollow sleeve, and said plug is inserted into the barrel of the firearm such that, when said first section is locked to said second section, said one end maintains the hammer in an uncocked, forward position and said plug is retained within the barrel, and wherein said plug is retained within the barrel until said lock is released.

2. The firearm safety device defined in claim 1 wherein said serrations extend a predetermined length along said arm to allow said second section to be locked in a selected one of a plurality of positions relative to said first section.

3. The firearm safety device defined in claim 1 wherein said lock is a combination lock.

4. The firearm safety device defined in claim 1 wherein said lock is a key lock.

5. The firearm safety device defined in claim 1 wherein said plug is removably attached to said second section.

6. The firearm safety device defined in claim 5 wherein said plug includes a stud removably attached to said second section and an annular sleeve removably attached to said stud.

7. A firearm safety device for installation on a firearm including a hammer and a barrel, the safety device comprising:

a generally U-shaped first section including one end extending around the hammer of the firearm and an opposite end having a pair of arms each provided with serrations formed along a portion thereof; and a second section including a releasable lock and a plug, said lock having a pair of bores formed therethrough for receiving the portions of said arms having said serrations, said lock engageable with said serrations and operative to lock said second section to said first section after said arms of said first section have been inserted into said bores of said lock and said plug is inserted into the barrel of the firearm such that, when said first section is locked to said second section, said one end maintains the hammer in an uncocked, forward position and said plug is retained within the barrel, and wherein said plug is retained within the barrel until said lock is released.

8. The firearm safety device defined in claim 7 wherein said lock is a combination lock.

9. The firearm safety device defined in claim 7 wherein said lock is a key lock.

10. The firearm safety device defined in claim 7 wherein said plug is removably attached to said second section.

11. The firearm safety device defined in claim 10 wherein said plug includes a stud removably attached to said second section and an annular sleeve removably attached to said stud.

12. The firearm safety device defined in claim 7 wherein said serrations extend a predetermined length along said am to allow said second section to be locked in a selected one of a plurality of positions relative to said first section.

13. A firearm safety device for installation on a firearm including a hammer and a barrel, the safety device comprising:

a first section including one end extending around the hammer of the firearm and an opposite end having an arm provided with serrations formed along a portion thereof; and a second section including a releasable combination lock and a plug, said lock having a bore formed therethrough for receiving said arm, said lock engageable with said serrations and operative to lock said second section to said first section after said arm of said first section has been inserted into said bore of said lock and said plug is inserted into the barrel of the firearm such that, when said first section is locked to said second section, said one end maintains the hammer in an uncocked, forward position-and said plug is retained within the barrel, and wherein said plug is retained within the barrel until said lock is released.

14. A firearm safety device for installation on a firearm including a hammer and a barrel, the safety device comprising:

a first section including one end extending around the hammer of the firearm and an opposite end having an arm provided with serrations formed along a portion thereof; and a second section including a releasable key lock and a plug, said lock having a bore formed therethrough for receiving said arm, said lock engageable with said serrations and operative to lock said second section to said first section after said arm of said first section has been inserted into said bore of said lock and said plug is inserted into the barrel of the firearm such that, when said first section is locked to said second section, said one end maintains the hammer in an uncocked, forward position and said plug is retained within the barrel, and wherein said plug is retained within the barrel until said lock is released.

15. A firearm safety device for installation on a firearm including a hammer and a barrel, the safety device comprising:

a first section including one end extending around the hammer of the firearm and an opposite end having an arm provided with serrations formed along a portion thereof; and a second section including a releasable lock and a plug removably attached to said second section, said lock having a bore formed therethrough for receiving said arm, said lock engageable with said serrations and operative to lock said second section to said first section after said arm of said first section has been inserted into said bore of said lock and said plug is inserted into the barrel of the firearm such that, when said first section is locked to said second section, said one end maintains the hammer in an uncocked, forward position and said plug is retained within the barrel, and wherein said plug is retained within the barrel until said lock is released, and said plug including a stud removably attached to said second section and an annular sleeve removably attached to said stud.

16. The firearm safety device defined in claim 15 wherein said arm of said first section is a first ann, said first section is generally U-shaped and includes a second arm extending generally parallel to said first arm, and said second section further includes a hollow sleeve for receiving said second ann of said first section when said first section is locked to said second section.

17. The firearm safety device defined in claim 15 wherein said first section is generally U-shaped and includes a pair of arms each provided with serrations formed along a portion thereof, said lock having a pair of bores formed therethrough for receiving the portions of said arms having said serrations and operative to lock said second section to said first section after said arms of said first section have been inserted into said bores of said lock and said plug is inserted into the barrel of the firearm.

18. The firearm safety device defined in claim 15 wherein said lock is a combination lock.

19. The firearm safety device defined in claim 15 wherein said lock is a key lock.

20. The firearm safety device defined in claim 15 wherein said serrations extend a predetermined length along said arm to allow said second section to be locked in a selected one of a plurality of positions relative to said first section.

* * * * *

UNITED STATES PATENT AND TRADEMARK OFFICE

CERTIFICATE OF CORRECTION

PATENT NO. : 5,446,988

DATED : September 5, 1995

INVENTOR(S) : Albert Frederick, Jr.

It is certified that error appears in the above-identified patent and that said Letters Patent is hereby corrected as shown below:

Col. 5
Claim 12, Line 10, after "along said", change "am" to -- arm --.

Col. 5
Claim 13, Line 31, before "and", change "position-" to -- position --.

Col. 6
Claim 16, Line 27, after "a first", change "ann" to -- arm --.

Claim 16, Line 31, after "second", change "ann" to -- arm --.

Signed and Sealed this

Seventh Day of November, 1995

*Attest:*

Bruce Lehman

BRUCE LEHMAN

*Attesting Officer*

*Commissioner of Patents and Trademarks*